US010215382B2

(12) United States Patent
Hesse et al.

(10) Patent No.: US 10,215,382 B2
(45) Date of Patent: Feb. 26, 2019

(54) LIGHTING UNIT WITH A LIGHTING UNIT HOUSING WHICH COMPRISES A PROFILED ELEMENT

(71) Applicant: ZUMTOBEL LIGHTING GMBH, Lemgo (DE)

(72) Inventors: Peter Hesse, Hessisch Oldensdorf (DE); Eugen Hildebrandt, Lemgo (DE)

(73) Assignee: ZUMTOBEL LIGHTING GMBH, Lemgo (DE)

( * ) Notice: Subject to any disclaimer, the term of this patent is extended or adjusted under 35 U.S.C. 154(b) by 64 days.

(21) Appl. No.: 14/646,679

(22) PCT Filed: Nov. 21, 2013

(86) PCT No.: PCT/EP2013/074378

§ 371 (c)(1),
(2) Date: May 21, 2015

(87) PCT Pub. No.: WO2014/079924

PCT Pub. Date: May 30, 2014

(65) Prior Publication Data

US 2015/0300611 A1 Oct. 22, 2015

(30) Foreign Application Priority Data

Nov. 23, 2012 (DE) ..... 10 2012 221 454

(51) Int. Cl.
*F21V 19/02* (2006.01)
*F21V 21/088* (2006.01)
(Continued)

(52) U.S. Cl.
CPC ..... *F21V 21/088* (2013.01); *F21S 4/28* (2016.01); *F21V 19/02* (2013.01); *F21V 23/026* (2013.01);
(Continued)

(58) Field of Classification Search
CPC .... F21V 21/088; F21V 23/026; F21V 23/023; F21V 27/02; F21V 15/013; F21V 17/14;
(Continued)

(56) References Cited

U.S. PATENT DOCUMENTS 5,707,136 A * 1/1998 Byers ..... F21V 3/02 362/145
5,848,838 A * 12/1998 Presta ..... F21V 21/08 248/224.7

(Continued)

FOREIGN PATENT DOCUMENTS

CH 669832 4/1989
DE 3825275 2/1990

(Continued)

OTHER PUBLICATIONS

International Search Report for PCT/EP2013/074378, English translation attached to original, Both completed by the Patent Office on Feb. 11, 2014, All together 6 Pages.

*Primary Examiner* — Anh T Mai
*Assistant Examiner* — Arman B Fallahkhair
(74) *Attorney, Agent, or Firm* — Brooks Kushman P.C.

(57) ABSTRACT

A lighting unit which has a lighting unit housing with a profiled element and which has a retaining element arranged on the profiled element for retaining another lighting unit component, for example a lighting unit top sleeve and/or an operating device. The lighting unit is designed such that the retaining element is held on the profiled element solely via a latching connection. The design allows the retaining element to be connected to the profiled element in a particularly simple manner. Additionally, no special fixing elements are required in order to attach the retaining element to the profiled element.

14 Claims, 10 Drawing Sheets

(51) Int. Cl.

| | |
|---|---|
| ***F21V 23/02*** | (2006.01) |
| ***F21S 4/28*** | (2016.01) |
| *F21V 27/02* | (2006.01) |
| *F21V 15/01* | (2006.01) |
| *F21V 17/14* | (2006.01) |
| *F21V 17/16* | (2006.01) |
| *F21Y 115/10* | (2016.01) |

(52) U.S. Cl.
CPC ..... *F21V 15/013* (2013.01); *F21V 17/14* (2013.01); *F21V 17/164* (2013.01); *F21V 23/023* (2013.01); *F21V 27/02* (2013.01); *F21Y 2115/10* (2016.08)

(58) Field of Classification Search
CPC ..... F21V 17/164; F21V 19/02; F21V 23/06; F21V 21/30; F21V 21/28; F21V 21/14; F21V 21/34; F21V 21/40; F21S 4/28; F21S 4/20
USPC ..... 362/362, 219, 225, 364, 656, 238, 285
See application file for complete search history.

(56) References Cited

U.S. PATENT DOCUMENTS

| | | | | |
|---|---|---|---|---|
| 6,217,192 | B1 * | 4/2001 | Stratton | F21V 19/0005 362/249.01 |
| 6,896,391 | B2 * | 5/2005 | Kotovsky | F21S 8/02 362/145 |
| 7,025,481 | B2 * | 4/2006 | Moll | B60Q 1/32 362/225 |
| 8,042,977 | B1 * | 10/2011 | Nourishad | F21S 2/005 362/217.05 |
| 8,115,411 | B2 * | 2/2012 | Shan | G09F 9/33 315/185 S |
| 8,308,323 | B2 * | 11/2012 | Holland | F21S 4/10 362/391 |
| 8,490,936 | B2 * | 7/2013 | Rinck | F21S 4/10 248/206.5 |
| 8,613,529 | B2 * | 12/2013 | Watanabe | F21V 19/001 362/294 |
| 8,888,335 | B2 * | 11/2014 | Wang | F21V 21/025 362/370 |
| 9,091,422 | B2 * | 7/2015 | Greenfield | F21V 3/00 |
| 2005/0002182 | A1 | 1/2005 | Kotovsky et al. | |
| 2009/0213621 | A1 * | 8/2009 | Hierzer | F21V 21/025 362/656 |

FOREIGN PATENT DOCUMENTS

| | | |
|---|---|---|
| DE | 29817256 | 12/1998 |
| DE | 10356064 | 6/2005 |
| DE | 102008051481 | 5/2009 |
| EP | 0265892 | 5/1988 |
| EP | 1293724 | 3/2003 |
| EP | 2093476 | 8/2009 |
| EP | 2138763 | 12/2009 |
| WO | 2010134887 | 11/2010 |

* cited by examiner

Latching sequence of device support 1

Latching sequence of device support 2

LIGHTING UNIT WITH A LIGHTING UNIT HOUSING WHICH COMPRISES A PROFILED ELEMENT

CROSS-REFERENCE TO RELATED APPLICATION

This application is the U.S. national phase of PCT Application No. PCT/EP2013/074378 filed on Nov. 21, 2013, which claims priority to DE Patent Application No. 10 2012 221 454.2 filed on Nov. 23, 2012, the disclosures of which are incorporated in their entirety by reference herein.

The invention relates to a lighting unit which has a lighting unit housing which comprises a profiled element.

Figure 12:
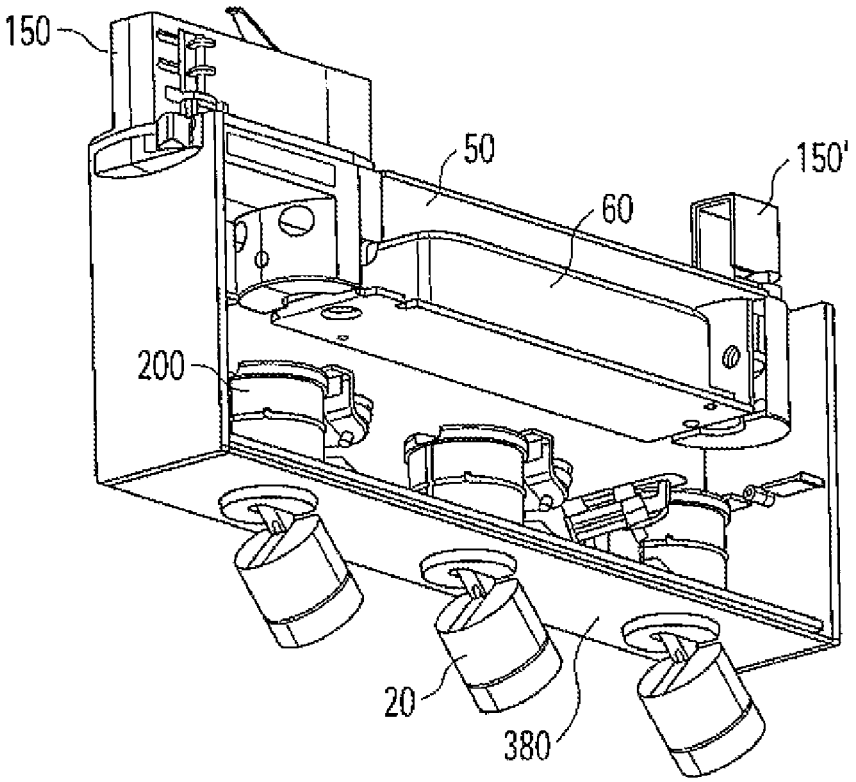
Fig. 12 Prior art

Such a lighting unit in the form of a spotlight is known from EP 2 138 763 A2. The spotlight has a lighting unit housing which is shown in FIG. 12, sketched in the open state. The lighting unit housing is provided to be connected mechanically and electrically to a bus-bar system (not shown) via adapters 150, 150'. The lighting unit housing comprises a bottom part 380 configured in the manner of a profile, to which a lighting unit top sleeve 200 for an illuminating head or lighting unit head 20 is fixed and can be set in different positions with respect to the lighting unit housing. The fastening of the sleeve 200 to the bottom part 380 uses an L-shaped retaining element made of sheet metal, which is riveted to the bottom part 380.

Arranged in the lighting unit head 20 is an LED light source (LED: light-emitting diode), for the operation of which the lighting unit also has an operating device 60; the latter is likewise arranged in the lighting unit housing, specifically in an upper receiving space 50.

Figure 13:
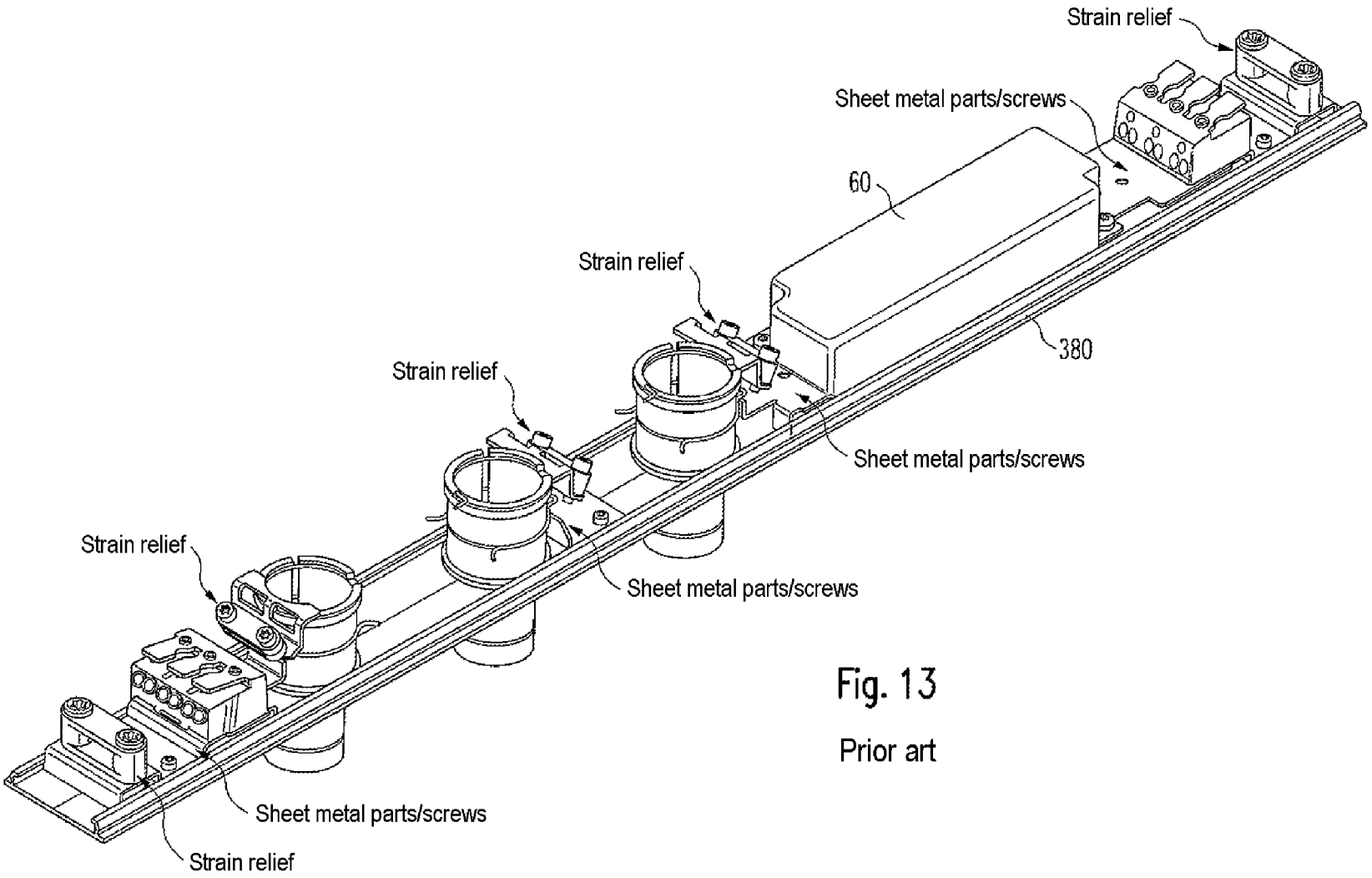
Fig. 13 Prior art

FIG. 13 shows a corresponding bottom part of a further, similar lighting unit. In this embodiment, the operating device 60 is also held on the bottom part 380. The retaining elements are configured as angled-over sheet metal parts in this case and fixed to the bottom part 380 with grub screws.

Fixing the retaining element or the retaining elements to the bottom part 380 of the lighting unit housing requires an outlay on costs and mounting which cannot be disregarded during the production of the lighting unit.

The invention is based on the object of specifying an improved lighting unit. In particular, the lighting unit is intended to permit easy mounting and to be able to be configured inexpensively.

According to the invention, this object is achieved by the subject matter specified in the independent claim. Particular types of embodiment of the invention are specified in the dependent claims.

According to the invention, a lighting unit is provided which has a lighting unit housing comprising a profiled element, and which has a retaining element arranged on the profiled element for retaining a flirther lighting unit component. Here, the lighting unit is configured in such a way that the retaining element is held on the profiled element solely via a latching connection.

By means of this configuration, the retaining element can be connected particularly simply to the profiled element. In addition, no special fixing element is required to fix the retaining element to the profiled element. Thus, the lighting unit can be assembled particularly simply and in a time-saving manner.

The fact that the latching connection acts on the profiled element may additionally be achieved in that the retaining element, viewed in the longitudinal direction of the profiled element, can in principle be attached at any desired point or position.

The retaining element is particularly suitable if the flirther lighting unit component is a lighting unit top sleeve and/or an operating device of the lighting unit.

The latching connection preferably has at least one latching element formed on the retaining element. In this way, in order to mount the retaining element, simple placement of the retaining element on the profiled element is made easier. In addition, a corresponding special component can thereby be avoided and saved.

Particularly simple production of the retaining element and the mounting of the retaining element on the profiled element can be effected if the retaining element consists of plastic.

The latching connection is preferably configured in such a way that it can be produced without any tool and preferably can also be released again reversibly. As a result, the assembly of the lighting unit is further made easier.

Particularly simple mounting is also made possible if the latching connection is configured in such a way that it can be produced by a rotating movement of the retaining element relative to the profiled element. Here, the lighting unit is preferably also configured in such a way that the rotating movement takes place about an axis of rotation which extends at right angles or parallel to a longitudinal axis of the profiled element.

The retaining element preferably has an attachment element for an operating device of the lighting unit. In this way, attachment of the operating device is made easier.

The retaining element preferably has a strain relief element. In this way, a separate part for strain relief can be saved.

The retaining element preferably has a cable guide. In this way, a separate guide for guiding a cable for the operating of the lighting unit can be saved.

The profiled element is preferably a covering element of the lighting unit housing.

Figure 1:
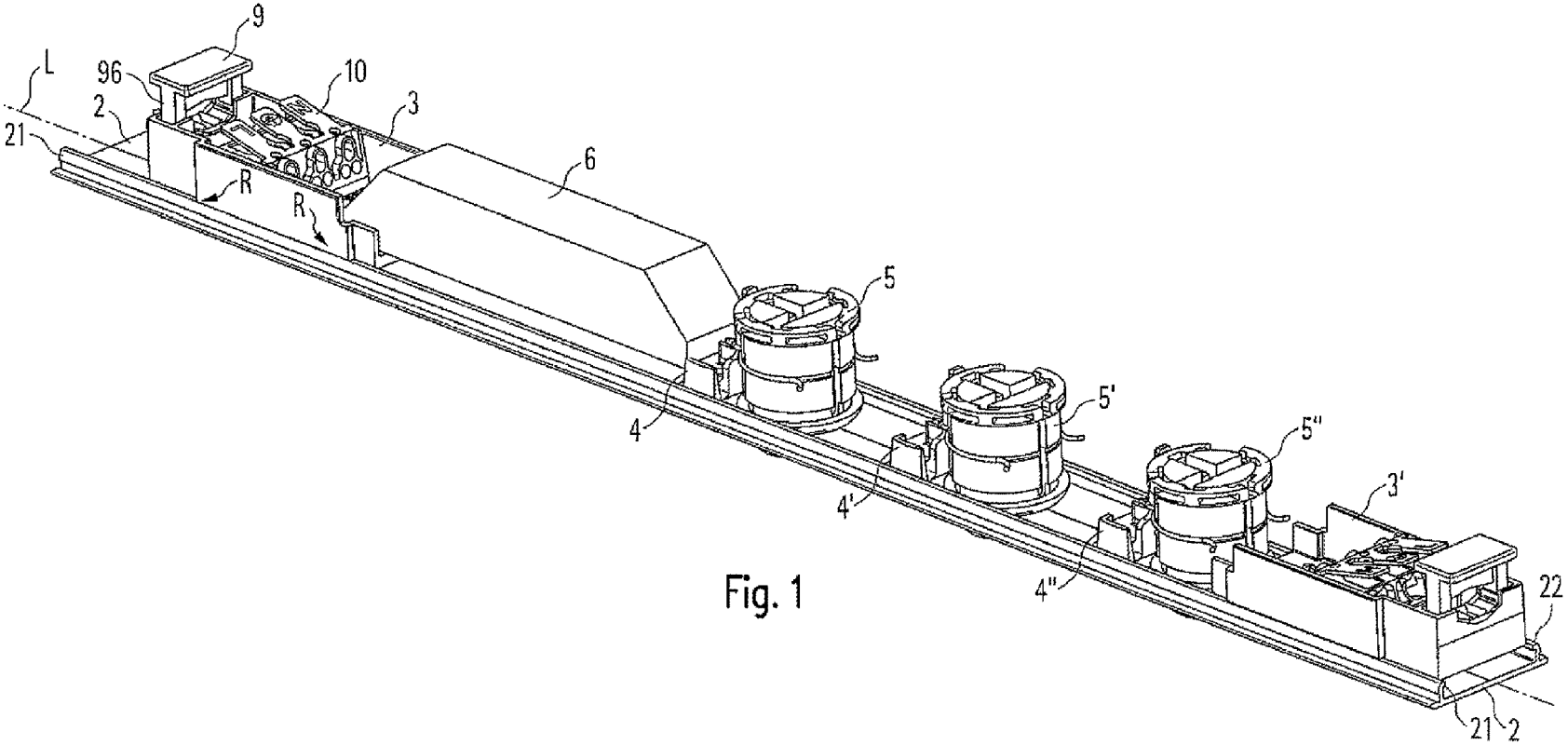
Figure 2:
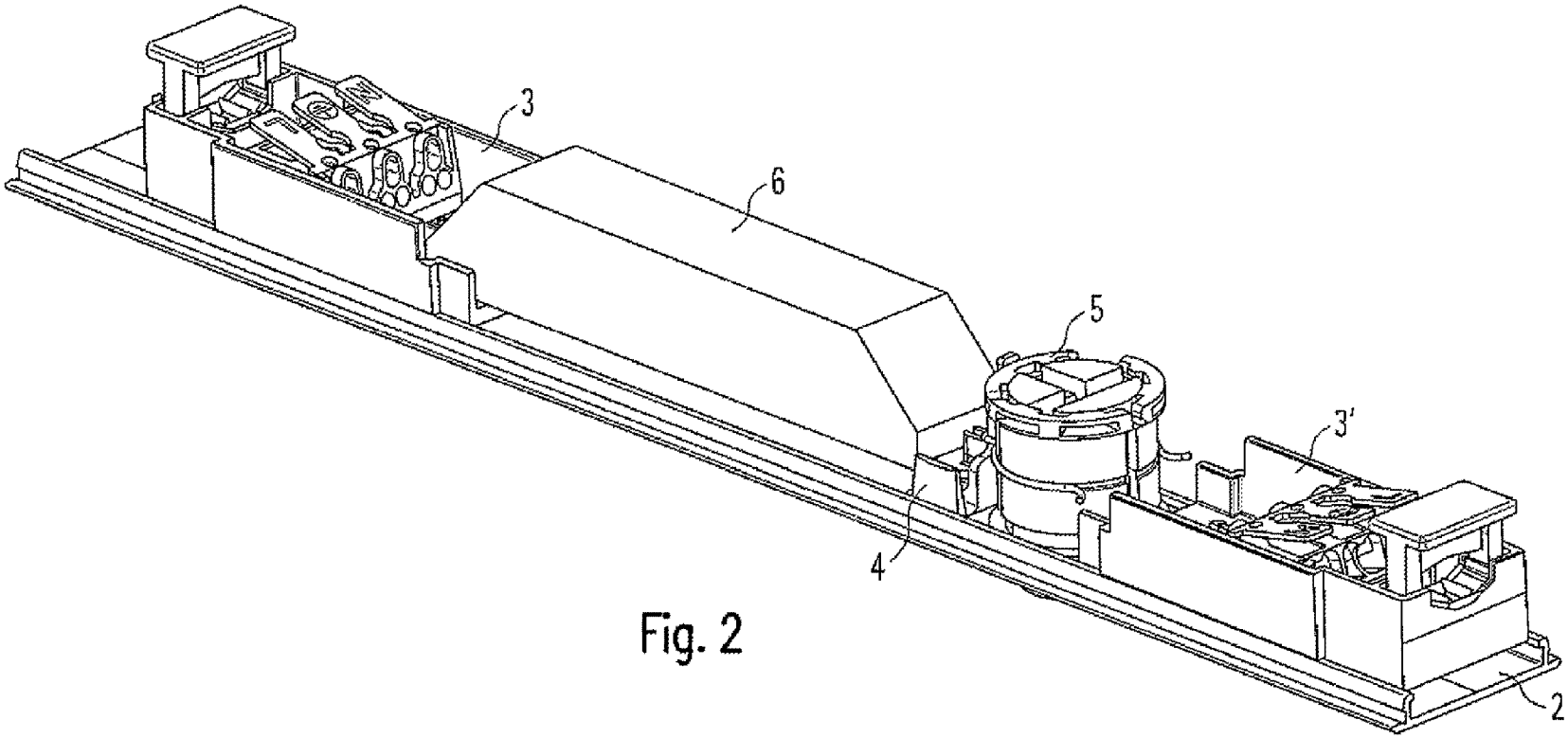
Figure 4:
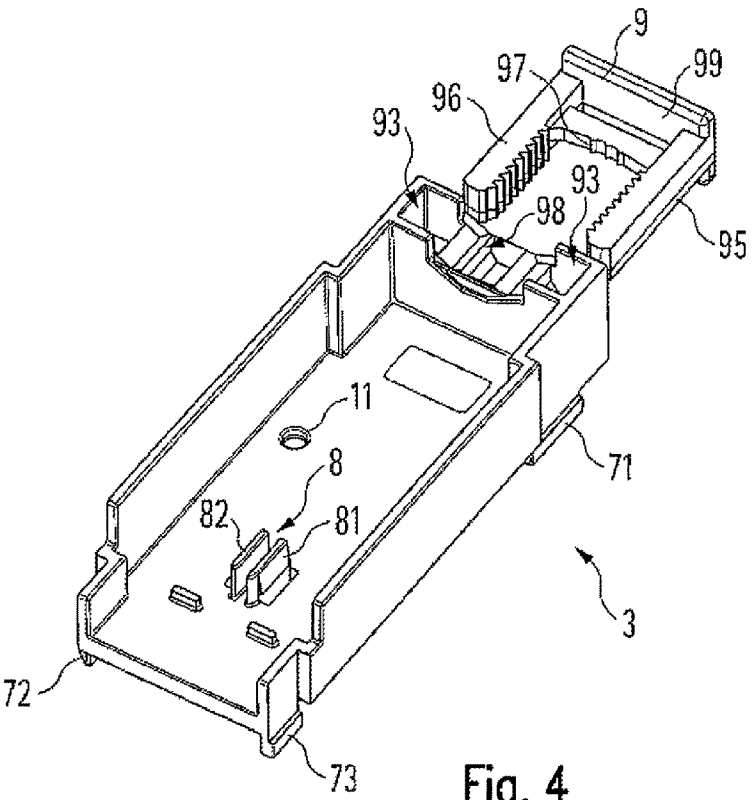
Figure 3:
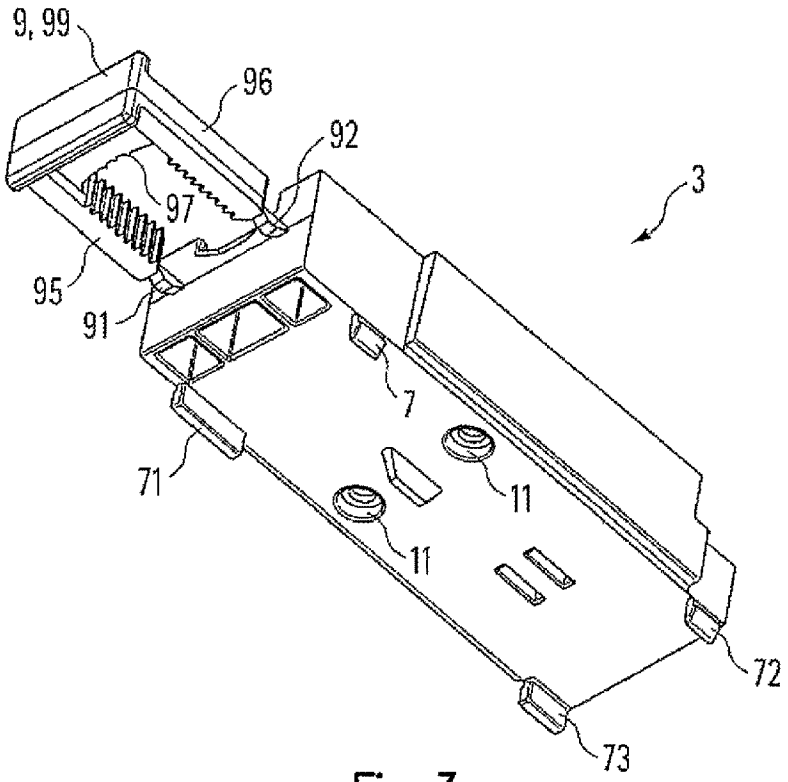
Figure 6:
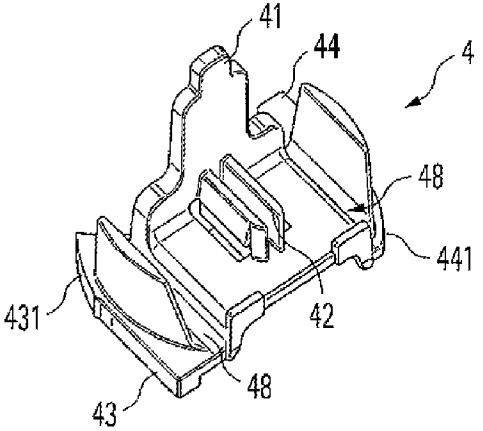
Figure 7:
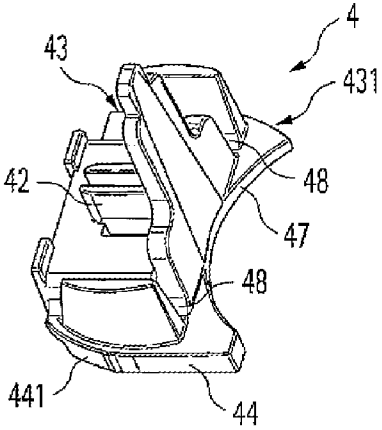
Figure 5:
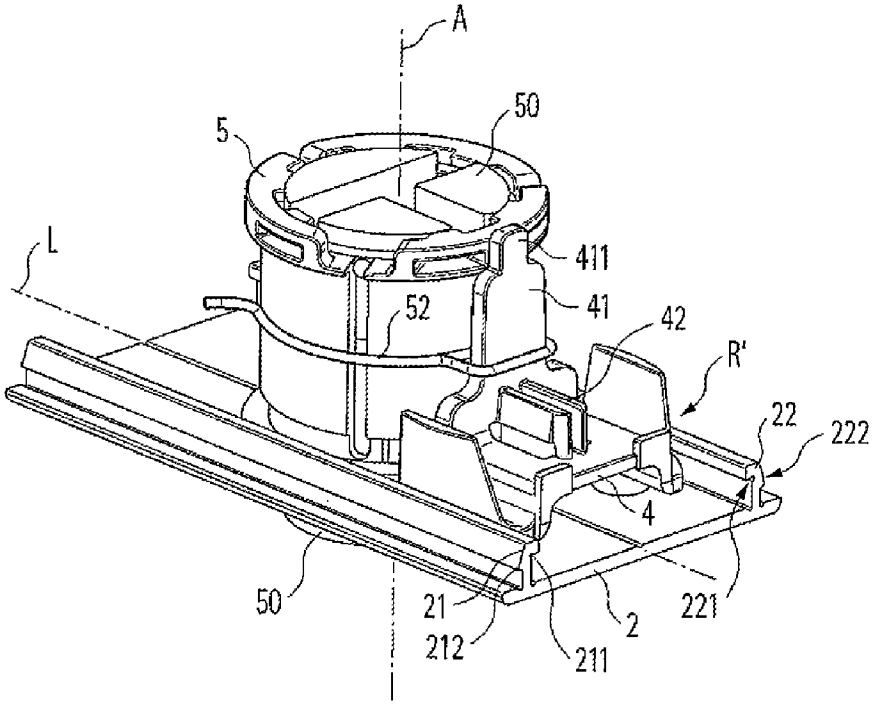
Figure 8:
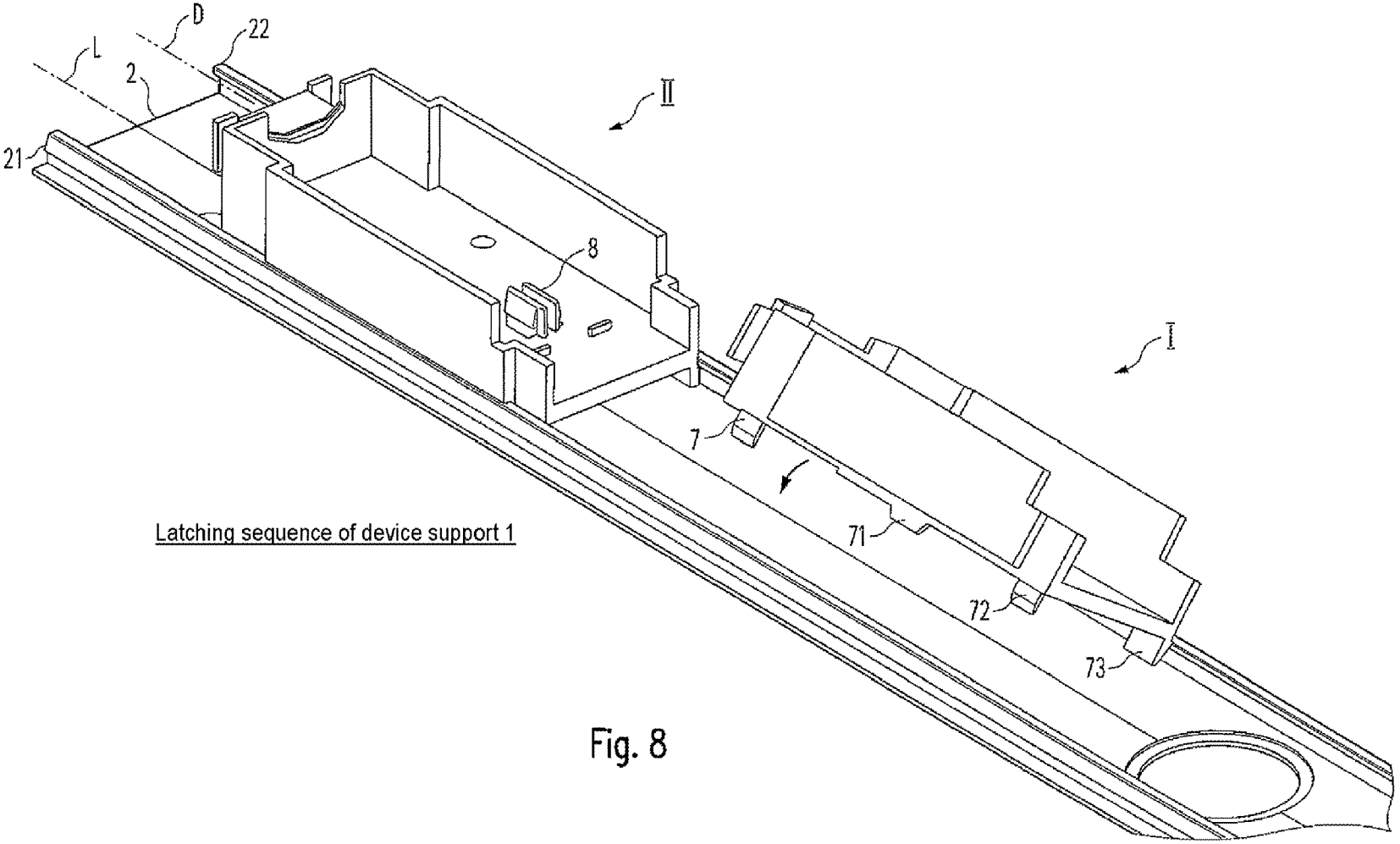
Figure 9:
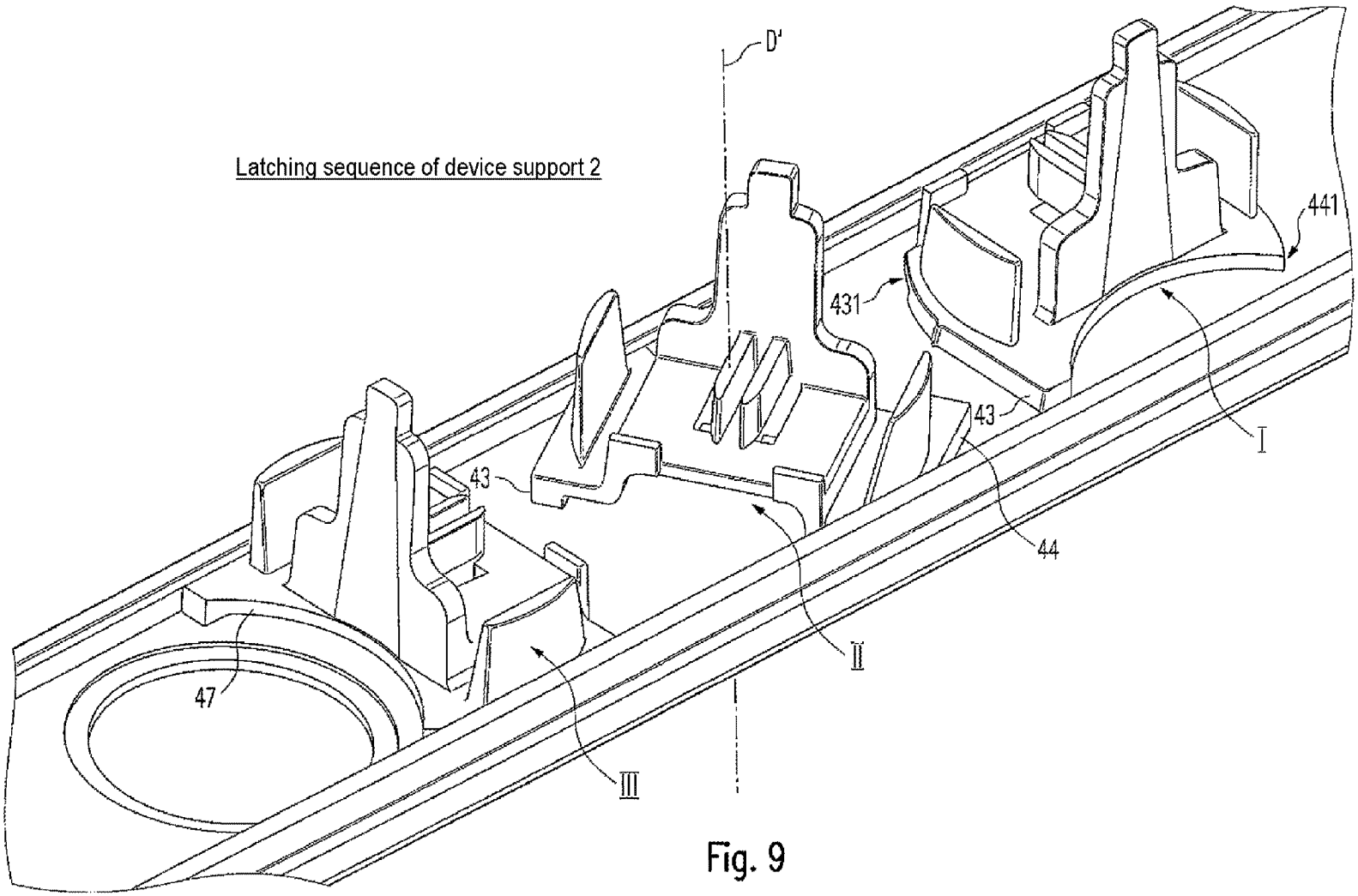
Figure 10:
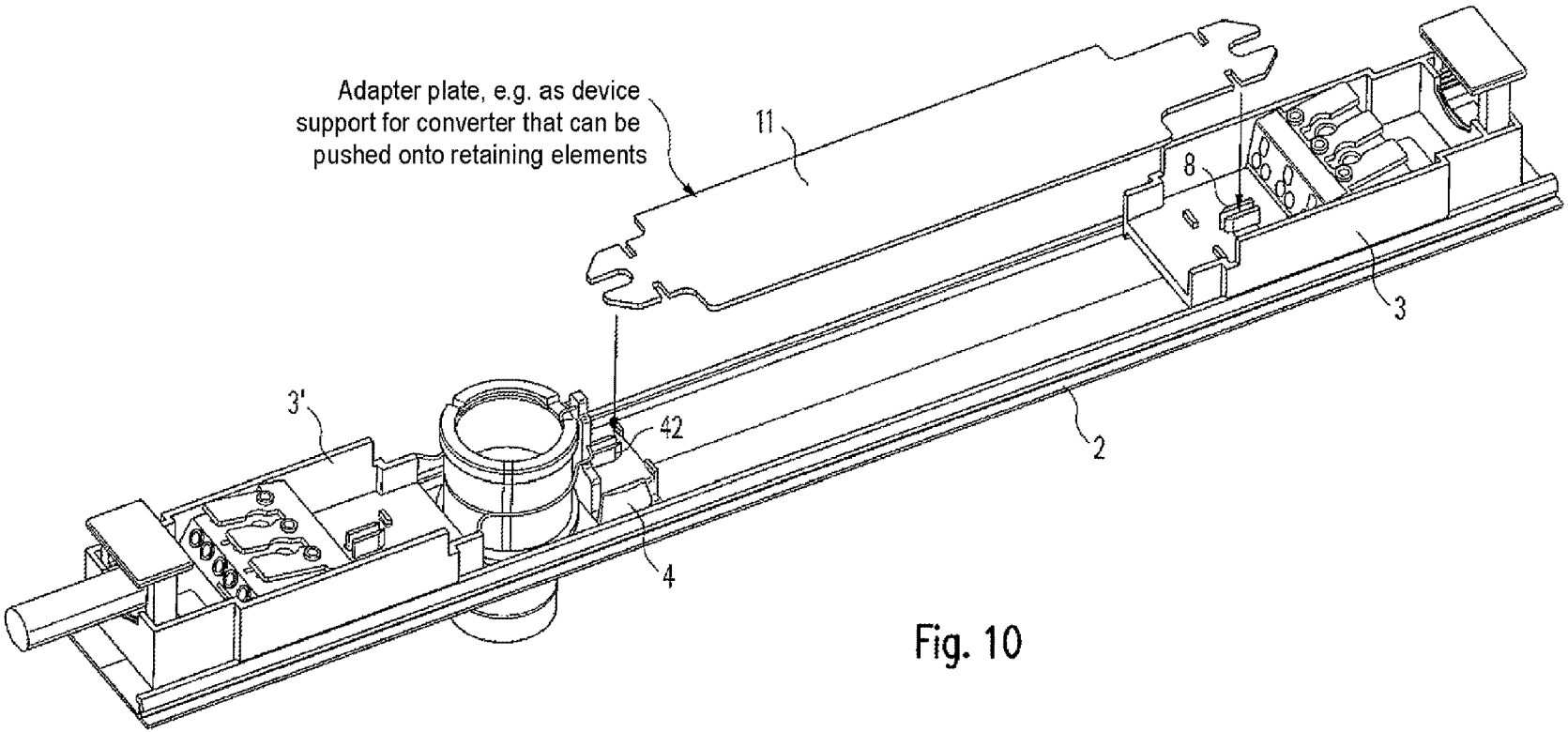
Figure 11:
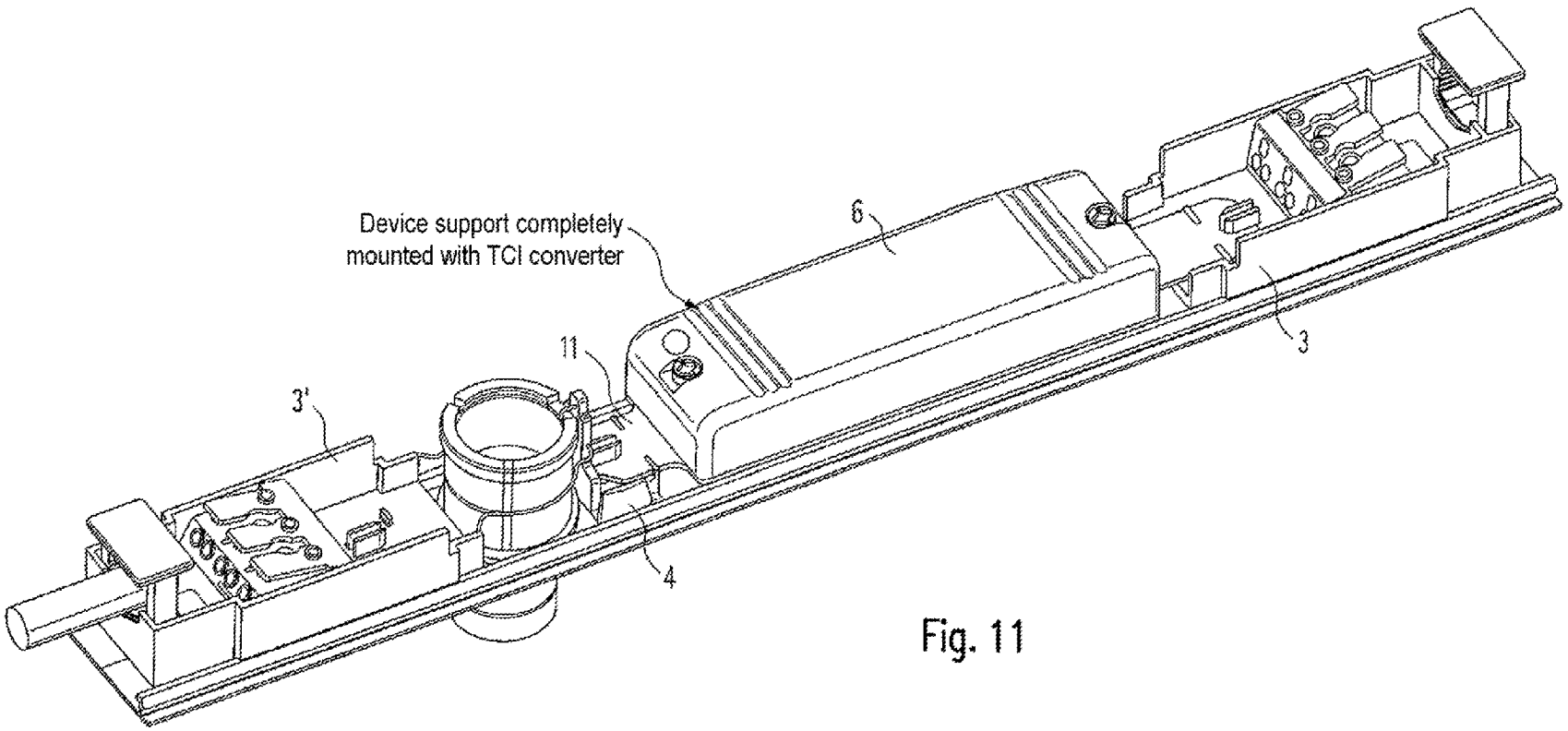

The invention will be explained in more detail below by using exemplary embodiments and with reference to the drawings, in which:

FIG. 1 shows a perspective sketch obliquely from above of a profiled element and a number of retaining elements and further lighting unit components of a lighting unit according to the invention, FIG. 2 shows a corresponding sketch of a variant, FIG. 3 shows a perspective sketch of a retaining element obliquely from below, FIG. 4 shows a corresponding sketch obliquely from above, FIG. 5 shows a perspective sketch of a further retaining element, mounted on a profiled element and having a lighting unit top sleeve, FIG. 6 shows a perspective sketch of the separated further retaining element obliquely from above, FIG. 7 shows a corresponding sketch from another viewing angle, FIG. 8 shows a sketch of the sequence of the mounting of the first-named retaining element on the profiled element, FIG. 9 shows a corresponding sketch of the sequence of the mounting of the flirther retaining element, FIG. 10 shows a sketch of the use of an adapter plate as a device support for an operating device of the lighting unit, FIG. 11 shows a flirther sketch of the latter, with the operating device mounted, FIG. 12 shows a sketch of a lighting unit according to the prior art, and FIG. 13 shows a sketch of a flirther lighting unit according to the prior art.

FIG. 1 shows a sketch of a lighting unit according to the invention. It is possible to see a profiled element 2, which forms part of a lighting unit housing (otherwise not shown in the figure). In particular, the profiled element 2 can be a covering element of the lighting unit housing, preferably—as is the case in the example shown—the bottom part of the lighting unit housing.

In the present description, it will be assumed that the profiled element 2 delimits the remainder of the lighting unit housing at the bottom or covers the same from the bottom. Accordingly, FIG. 1 shows a view obliquely from above. The lighting unit housing is configured such that, in the assembled state of the lighting unit, it encloses the further parts sketched in FIG. 1. To this extent, the embodiment corresponds to the known lighting unit shown in FIG. 10.

The aforementioned configuration as a covering element from below is, however, not mandatory. Alternatively, the profiled element 2 can, for example, be configured to cover the lighting unit housing laterally. In principle, the invention is suitable for an orientation of the profiled element that is arbitrary to this extent. Only for the purpose of simpler description will it be assumed here that the profiled element 2 is a bottom part. If appropriate, the statements of direction, etc, should be reinterpreted accordingly.

The shape of the profiled element 2 defines a longitudinal axis L. In FIG. 5 the profiled element 2 is sketched as being slightly larger. The profiled element 2 has two edge regions, which extend parallel to the longitudinal axis L, a first limb 21 oriented upward being formed on a first of the two edge regions, and a second limb 22 oriented upward being formed on a second of the two edge regions. The remaining part of the profiled element 2 is preferably configured to be at least substantially plate-like, so that the profiled element in cross section, so to speak, is slightly U-shaped. Formulated more generally, therefore, the two aforementioned limbs 21, 22 are oriented so as to project toward an interior of the lighting unit housing.

The first upwardly oriented limb 21 has a shoulder limb 211, which points in the direction of the second upwardly oriented limb 22. In addition, on the first upwardly oriented limb 21, a further shoulder limb 212, which is formed on the side opposite to the first-named shoulder limb 211, is preferably also provided. The last-named, further shoulder limb 212 is provided for fixing the profiled element 2 to the lighting unit housing.

The profiled element 2 is preferably formed symmetrically, to be specific in relation to a vertical plane of symmetry which is oriented parallel to the longitudinal axis L.

Accordingly, the second upwardly oriented limb 22 has corresponding shoulder limbs 221, 222.

Once more with reference to FIG. 1, the lighting unit also has a retaining element 3, which is configured to hold a further lighting unit component, here in the form of an operating device 6 of the lighting unit. In FIG. 3, the retaining element 3 is sketched in separated form obliquely from below, in FIG. 4 in a corresponding way obliquely from above.

The lighting unit is configured in such a way that the retaining element 3 is arranged on the profiled element 2 held only—as indicated in FIG. 1—via a latching connection R. In this way, the retaining element 3 can be fixed and mounted particularly simply on the profiled element 2.

Preferably, the retaining element 3 has at least one latching element 7—shown by way of example in FIG. 3—for this purpose. In the example shown, the latching element 7 is designed to interact with the shoulder limb 211 of the first upwardly oriented limb 21 of the profiled element 2 to form the latching connection R. The retaining element 3 preferably additionally has a further latching element 71, which is configured to interact with the shoulder limb 221 of the second upwardly oriented limb 21 of the profiled element 2 to form the latching connection R, so that the two latching elements 7, 71 press against the profiled element 2 in opposite directions when the latching connection R has been produced as envisaged.

Particularly good stability of the connection can be achieved if the retaining element 3 additionally has two further latching elements 72, 73, which are configured in a way analogous to the two first-named latching elements 7, 71, specifically in relation to the longitudinal axis L at another point.

Particularly suitably, the retaining element 3 consists of plastic, in particular it can be a plastic molding. It is further preferably formed in one piece.

By using the embodiment shown here, it is possible to achieve the situation in which the latching connection R can be produced without any tool. It can also be released again without any tool; the configuration is preferably such that the retaining element 3 is reversibly connected to the profiled element 2 via the latching connection R and can also be released again.

The way in which the retaining element 3 can be mounted on the profiled element 2 is sketched in FIG. 8. In the example shown, the latching connection R is configured in such a way that it can be produced by a rotating movement of the retaining element 3 relative to the profiled element 2. For this purpose, the retaining element 3 can first be placed—in an oblique position—with the two latching elements 71, 73 on the second upwardly oriented limb 22 of the profiled element 2—as indicated in FIG. 8 by a position I. The retaining element 3 can then be rotated about an axis of rotation D, which extends parallel to the longitudinal axis L, until the latching elements 7, 72 engage in a latching manner under the shoulder limb 211 in order to produce the latching connection R and thus a position II is finally reached, which corresponds to the relative arrangement between the retaining element 3 and the profiled element 2 envisaged for operation of the lighting unit. The retaining element 3 can, so to speak, be clipped in on the profiled element 2.

By means of this configuration, it is in particular possible to achieve the situation in which the retaining element 3 can in principle be mounted at any desired point on the profiled element 2 in relation to the longitudinal axis L.

As shown by way of example in FIG. 4, the retaining element 3 preferably additionally has an attachment element 8 for the connection to the operating device 6. In the example shown, the attachment element 8 is formed by two upwardly projecting shoulders 81, 82, which extend parallel to the longitudinal axis L. In this way, the operating device 6 can be connected to the retaining element 8 in different longitudinal positions relative to the latter. The operating device 6 therefore does not have to be attached accurately at a point—in relation to the longitudinal axis L—to be connected to the retaining element 3. In this way, the mounting of the operating device 6 is made easier.

Preferably, the configuration is such that the operating device 6 can be connected to the retaining element 3 to be fixed to the latter, without using any tools.

Here, the attachment element 8 is in principle suitable for different operating devices.

Further preferably, in the example shown here, the retaining element 3 comprises a strain relief element 9. The strain relief element 9 is configured for the strain relief of an electric cable (not shown in the figures), which is provided for a power connection to the operating device 6.

In the embodiment shown here, the strain relief element 9 is U-shaped, so that it has two U limbs 95, 96 and a connecting limb 99 connecting the two U limbs 95, 96; here, the two U limbs 95, 96 have rows of teeth pointing inward—in relation to the U shape. Furthermore, the retaining element 3 has two receiving regions 93, which are configured to receive the two U limbs 95, 96 in a latching manner and accordingly each have an outwardly pointing edge which is designed to interact with the corresponding row of teeth of the relevant U limb 95 or 96.

In the example shown, the two receiving regions 93 are formed by openings which extend vertically and are open at the top, so that the strain relief element 9 can be inserted with its two U limbs 95, 96 into the receiving regions 93 from above. Alternatively, the receiving regions 93 can, for example, be formed by lateral cut-outs in the retaining element 3.

A first pressing surface 98 is formed between the two receiving regions 93, and a second pressing surface 97 is formed on the connecting limb 99, the two aforementioned pressing surfaces 98, 97 being configured to compress the electric cable.

The configuration of the retaining element 3 is preferably such that, in a first state of the retaining element 3, the strain relief element 9 is connected to the remainder of the retaining element 3 solely via at least one intended fracture point, here via two intended fracture points 91, 92. For the purpose of mounting, this connection can then be released simply—for example by bending over—and the strain relief element 9 can subsequently be inserted with its two U limbs 95, 96 into the two receiving regions 93 from above, the cable being clamped in between the two pressing surfaces 98, 97 for strain relief. Sketched in FIG. 1 is a state in which the strain relief element 9 is appropriately connected to the remainder of the retaining element 3 (without a cable in the drawing).

Further preferably, the retaining element 3 has at least one further attachment element 11—sketched by way of example in FIGS. 3 and 4—for a terminal 10—sketched in FIG. 1—for the cable. In the example shown, the further attachment element 11 is configured in the form of at least one cut-out or a hole, into which the terminal 10 can be inserted, engaging with an appropriately corresponding projection.

As further sketched by way of example in FIG. 1, the lighting unit additionally has a further retaining element 4. In FIG. 5, the further retaining element 4 is shown on a shorter section of the profiled element 2 from another viewing direction. FIGS. 6 and 7 show the further retaining element 4 in separated form obliquely from above from two different viewing directions The further retaining element 4 is configured to hold a lighting unit top sleeve 5. The lighting unit top sleeve 5 serves to receive a lighting unit top 50 which has a light source, for example an LED light source, for the emission of light from the lighting unit. The configuration is preferably such that the lighting unit top 50 is mounted such that it can move relative to the lighting unit top sleeve 5, in particular in a vertical direction along a vertical axis A. For this purpose, in the lower extension of the lighting unit top sleeve 5, a circular opening is formed in the profiled element 2, through which opening the lighting unit top 50 can be moved up and down along the axis A.

In order to hold the lighting unit top sleeve 5, the further retaining element 4 has an upwardly oriented extension 41. In the example shown, a clamp 52 is arranged around this extension 41 and the lighting unit top sleeve 5, so that the lighting unit top sleeve 5 is preferably mounted on the extension 41 such that it can be rotated about the axis A.

In its lower end region, the flirther retaining element 4 preferably has a concave indentation 47, the curvature of which matches the shape of the lighting unit top sleeve 5. It is preferably configured in such a way that it forms a contact or sliding surface during a rotating movement of the lighting unit top sleeve 5 about the axis A.

At its upper end, the extension 41 preferably has a lug 411, which serves as a rotating stop for a rotating movement of the lighting unit top sleeve 5 about the axis A.

Further preferably, the further retaining element 4 has an attachment element 42 for the operating device 6, which is preferably formed in an analogous or identical way to the corresponding attachment element 8 of the first-named retaining element 3. The attachment element 42 of the flirther retaining element 3 is preferably designed to adjoin the extension 41 directly.

As indicated in FIG. 1, the configuration is preferably such that the operating device 6 is held firstly on the retaining element 3 and secondly on the flirther retaining element 4.

The further retaining element 4—just like the first-named retaining element 3—is held on the profiled element 2 via a latching connection R'. For this purpose, the further retaining element 4 has two latching elements 43, 44, which are configured so as to engage under the two shoulder limbs 211, 221 that point toward each other and belong to the two upwardly oriented limbs 21, 22 of the profiled element 2.

FIG. 9 shows a sketch of how the further retaining element 4 can be mounted on the profiled element 2. In the example shown, the latching connection R' is configured in such a way that it can be produced by a rotating movement or sliding-rotating movement of the retaining element 3 relative to the profiled element 2, in this case the rotating movement extending about a vertical axis of rotation D'.

To produce the latching connection R', the further retaining element 4 is firstly rotated through 90°—with respect to its envisaged position—with the two latching elements 43, 44 placed between the two upwardly oriented limbs 21, 22. This is indicated in FIG. 9 by a position I. The further retaining element 4 is then rotated about the axis of rotation D'—as indicated by a position II—until the two matching elements 43, 44 finally engage under the shoulder limbs 211, 221, latching in their envisaged positions, as indicated in a position III.

By means of this configuration, it is also possible to achieve the situation in which the retaining element 3 can in principle be mounted at any desired point on the profiled element 2 in relation to the longitudinal axis L.

The aforementioned movement of the further retaining element 4 in order to produce the connection may be made easier if the two latching elements 43, 44 each have convexly shaped run-on regions 431, 441.

Further preferably, the further retaining element 4 has at least one cable guide 48, preferably two cable guides 48, which are in particular designed to extend parallel to the longitudinal axis L. The two cable guides 48 are preferably formed on two opposite sides of the attachment element 42, in particular at a level underneath the attachment element 42.

In the example sketched in FIG. 1, a second retaining element 3', which is configured so as to be identical to the first-named retaining element 3, is additionally provided in addition to the first-named retaining element 3. In the following text, these retaining elements 3, 3' will be designated retaining elements of a "first type".

In an analogous way, a second retaining element 4', which is configured in an analogous or identical way to the further retaining element 4, is provided in addition to the latter, as is a corresponding third retaining element 4"—in the following text, these retaining elements 4, 4', 4", will correspondingly be designated retaining elements of a "second type".

In the arrangement sketched in FIG. 1, two retaining elements 3, 3' of the first type, and a total of three retaining elements 4, 4', 4" of the second type, are provided on the profiled element 2. In the variant of the profiled element 2 sketched in FIG. 2, two retaining elements 3, 3' of the first type are provided and exactly one retaining element 4 of the second type. Accordingly, in the arrangement sketched in FIG. 1, three lighting unit top sleeves 5, 5', 5" are provided, and in the arrangement sketched in FIG. 2, only one lighting unit top sleeve 5 is provided.

Formulated generally, preferably two retaining elements 3, 3' of the first type are provided and at least one retaining element 4 of the second type.

The two retaining elements 3, 3' of the first type are preferably arranged—in relation to the longitudinal axis L—in two opposite end regions of the profiled element 2, in this case specifically rotated through 180° with respect to each other, so that the two strain relief elements point outward. These two retaining elements 3, 3' of the first type can be used as clamping retainers and strain relief means for through-wiring of the lighting units.

As indicated in FIG. 10, the retaining element 4 or one of the retaining elements 4 of the second type is preferably provided together with one of the two retaining elements 3, 3'—here with the retaining element 3—of the first type in order to hold the operating device 6. For this purpose, an adapter plate 11 can in particular be provided, being configured in such a way that it can be pushed onto the two corresponding attachment elements 8, 42 of the two retaining elements 3, 4, as indicated by two arrows in FIG. 10. Then—as shown in FIG. 11—the operating device 6 can then be fixed to the adapter plate 11 in a further step.

Once more with reference to the arrangement shown by way of example in FIG. 1, a first retaining element 4 of the second type can be used to hold a first lighting unit top sleeve 5. The two further retaining elements 4, 4' of the second type are each used to hold a further lighting unit top sleeve 5', 5". The retaining elements 4, 4', 4" of the second type are in this case arranged—in relation to the longitudinal axis L—between the two retaining elements 3, 3' of the first type.

By means of the invention, it is possible to achieve the situation in which the lighting unit can be produced in a considerably reduced mounting time and at the same time with a reduced number of components.

The invention claimed is:

1. A lighting unit, having lighting unit housing comprising a profiled element having a U-shaped cross section with a center portion and opposed side walls, the profiled element extending axially along a longitudinal axis defining a planar surface having a plurality circular opening extending there through sized to receive a plurality of lighting unit tubular sleeves, a plurality of retaining elements, arranged in longitudinally spaced apart relation along the axis of the profiled element, for retaining the plurality of lighting unit tubular sleeves aligned with the plurality apertures, each of the plurality of retaining elements have an upwardly oriented extension protruding from the profiled element along the vertical direction, and each of the plurality of lighting unit tubular sleeves include a clamp arranged around the lighting unit tubular sleeve and the extension of a corresponding retaining element, and a plurality of lighting unit components mounted within the plurality lighting unit tubular sleeves such that they can move relative to the lighting unit tubular sleeves in a vertical direction along a vertical axis (A), wherein the circular openings formed in the profiled element, through which the lighting unit tubular sleeves extend enable the tubular sleeves to be moved up and down along the axis (A);

convexly shaped latching elements formed on opposite sides of each of the plurality of the retaining elements engage under the two shoulder limbs formed on the opposed side walls of the profiled element, wherein the profiled element and the retaining element are configured in such a way that the retaining element is held on the profiled element side walls solely via a latching connection of the latching elements.

2. The lighting unit as claimed in claim 1 wherein the plurality of lighting unit components comprise a light unit, or power supply for the lighting unit.

3. The lighting unit as claimed in claim 1, in which the latching connection has at least one latching element formed on the retaining element.

4. The lighting unit as claimed in claim 1, in which the retaining element consists of plastic.

5. The lighting unit as claimed in claim 1, in which the latching connection is configured in such a way that it can be produced without any tool and can also be released again reversibly.

6. The lighting unit as claimed in claim 1, in which the latching connection is configured in such a way that it can be produced by a rotating movement of the retaining element relative to the profiled element.

7. The lighting unit as claimed in claim 6, which is configured in such a way that a rotating movement of the lighting unit tubular sleeves may take place about an axis (A) which extends at right angles to the longitudinal axis of the profiled element.

8. The lighting unit as claimed in claim 1, in which the retaining element has an attachment element for connecting to a power supply for the lighting unit.

9. The lighting unit as claimed in claim 1, in which the retaining element further comprises a wire strain relief element for grasping a wire providing power to the lighting unit.

10. The lighting unit as claimed in claim 1, in which the retaining element further comprises a cable guide.

11. The lighting unit as claimed in claim 1, in which the profiled element further comprises a covering element of the lighting unit housing.

12. A lighting unit, comprising:

a profiled element having a generally U-shaped cross section with a center portion and opposed side walls, the profiled element extending axially along a longitudinal axis defining a planar surface having one or more apertures extending there through sized to receive a lighting unit component having a tubular housing there through, a first retaining element, arranged on the profiled element, for retaining a strain relief element for power supply cable of the lighting unit;

one or more second retaining units, spaced along the profile element from one another and the first retaining element, configured to connect the tubular housings which are sized to receive a light unit aligned with the one or more apertures;

each of the second retaining units have an upwardly oriented extension protruding from the profiled element along the vertical direction, and each of the plurality of lighting unit tubular housings include a clamp arranged around the lighting unit tubular housing and the extension of a corresponding retaining unit convexly shaped latching elements formed on opposite sides of each of the plurality of the retaining elements engage under the two shoulder limbs formed on the opposed side walls of the profiled element, wherein first retaining element and the one or more second retaining elements are held on the profiled element solely via a latching connection of the latching elements.

13. The lighting unit as claimed in claim 12, wherein the second retaining units are sized to fit within the U-shaped cross section of the profiled element and latch via a rotating movement about an axis (A) which extends at right angles to the planar surface.

14. The lighting unit as claimed in claim 12, further comprising one or more light unit wherein the tubular housings surrounding a light unit, each associated with one of the second retaining units.

* * * * *